US007686197B2

(12) United States Patent
Kosuge et al.

(10) Patent No.: US 7,686,197 B2
(45) Date of Patent: Mar. 30, 2010

(54) GAS COMBUSTION TYPE STRIKING TOOL

(75) Inventors: Makoto Kosuge, Tokyo (JP); Hajime Takemura, Tokyo (JP); Junichi Tamura, Tokyo (JP); Katsuhiko Murayama, Tokyo (JP)

(73) Assignee: Max, Co., Ltd., Tokyo (JP)

( * ) Notice: Subject to any disclaimer, the term of this patent is extended or adjusted under 35 U.S.C. 154(b) by 115 days.

(21) Appl. No.: 11/920,548

(22) PCT Filed: May 17, 2006

(86) PCT No.: PCT/JP2006/309820

§ 371 (c)(1),
(2), (4) Date: Nov. 16, 2007

(87) PCT Pub. No.: WO2006/123693

PCT Pub. Date: Nov. 23, 2006

(65) Prior Publication Data

US 2008/0314951 A1 Dec. 25, 2008

(30) Foreign Application Priority Data

May 17, 2005 (JP) ..... 2005-144122

(51) Int. Cl.
*B25C 1/08* (2006.01)
*B25C 1/18* (2006.01)

(52) U.S. Cl. ..... 227/10; 227/8; 227/9; 227/109; 227/119

(58) Field of Classification Search ..... 227/9, 227/10, 109, 130, 119, 8, 120, 125, 135, 227/136, 137
See application file for complete search history.

(56) References Cited

U.S. PATENT DOCUMENTS

| | | | | |
|---|---|---|---|---|
| 2,009,580 | A * | 7/1935 | Govanus | 227/136 |
| 6,149,046 | A * | 11/2000 | Ho et al. | 227/8 |
| 2003/0034377 | A1 * | 2/2003 | Porth et al. | 227/10 |

FOREIGN PATENT DOCUMENTS

| | | |
|---|---|---|
| JP | 4-28970 | 3/1992 |
| JP | 5-72380 | 10/1993 |
| JP | 8-252806 | 10/1996 |
| JP | 11-179675 | 7/1999 |

* cited by examiner

*Primary Examiner*—Rinaldi I. Rada
*Assistant Examiner*—Nathaniel Chukwurah
(74) *Attorney, Agent, or Firm*—Drinker Biddle & Reath LLP

(57) ABSTRACT

In a gas combustion type striking tool which strikes a fastener supplied in a nose portion into a member to be fastened by burning mixed gas inside a combustion chamber above a striking cylinder in accordance with a pulling operation of a trigger lever to drive a striking piston and a driver by a pressure of the combustion gas thus generated, a topper is disposed so as to be able to protrude into a path of a feed pawl or a feed piston, and a stopper engaging member, which extends downward from the striking cylinder and is movable in a vertical direction, engages with the stopper when the stopper engaging member moves downward, thereby retracting the stopper from the path.

8 Claims, 12 Drawing Sheets

GAS COMBUSTION TYPE STRIKING TOOL

TECHNICAL FIELD

The present invention relates to a gas combustion type striking tool.

BACKGROUND ART

As an example of a gas combustion type striking tool, there is known a combustion-gas driven striking machine which is operable to: inject combustible gas into a combustion chamber sealed inside a body; stir mixed gas of the combustible gas and air inside the combustion chamber; burn the mixed gas thus stirred inside the combustion chamber to generate high-pressure combustion gas inside the combustion chamber, and act the high-pressure combustion gas on a striking piston accommodated inside a striking cylinder to strikably drive the striking piston inside the striking cylinder, thereby striking a nail supplied to a nose portion beneath the body into a steel plate or a concrete with a driver coupled to the lower surface side of the striking piston. Such combustion-gas driven striking machines is configured as a portable tool equipped with a vessel, such as a gas container, which is filled with combustible gas and is arranged inside the tool, and a battery which serves a power source for igniting the combustible gas and is attached to the tool. Thus, a work for striking a nail or a pin can be carried out without being restricted by power supply sources such as electric power or compressed air.

The gas combustion type striking tool as described above is provided with a feeding mechanism which sequentially feeds coupled fasteners housed inside a magazine toward the nose portion. In some feeding mechanisms, linearly coupled fasteners are housed within a sheath-shaped magazine, and the coupled fasteners are constantly pressed toward a side of the nose portion by a spring having a constant output, whereby, immediately after the first fastener supplied at a shooting port of the nose portion is driven, the subsequent fastener is supplied inside the nose portion.

Because the number of fasters that can be housed inside such straight-type magazines is small, some gas combustion type striking tools are equipped with a cylindrical magazine inside which fasteners coupled in a coiled manner are housed.

A feed piston-cylinder mechanism is generally used as a fastener feeding mechanism for cylindrical magazines. The feed piston-cylinder mechanism is configured such that a feed piston is slidably accommodated inside a feed cylinder and is provided with a feed pawl engagable with the coupled fasteners housed inside the magazine, whereby the feed pawl reciprocates in a nail feed direction in which the feed pawl is fed toward the side of the nose portion and in a retracting direction opposite thereto.

When the gas combustion type striking tool employs the cylindrical magazine together with the feed piston-cylinder mechanism, the feed piston of the feed piston-cylinder mechanism may be reciprocated by utilizing a spring and a pressure of the combustion gas inside the combustion chamber. More specifically, the combustion chamber may be coupled to a front portion of the feed cylinder through a gas tube so that the feed piston is reciprocated such that it is fed forwardly by the spring and is retraced by the gas pressure form the gas tube.

However, according to the aforesaid configuration, when the fastener is struck by driving the driver together with the striking piston, the combustion gas inside the combustion chamber is simultaneously fed to the feed cylinder to retract the feed piston. Thereafter, when the combustion gas is cooled so that the pressure inside the combustion chamber becomes negative pressure, the striking piston returns due to the pressure difference. Simultaneously, the pressure inside the gas feeding portion of the feed cylinder also becomes negative pressure, whereby the feed piston moves in the nail feed direction due to the spring force. At this time, since the movement of the feed piston due to the spring force is faster than the returning movement of the striking piston, there sometimes arises a phenomenon that the front fastener being fed toward the nose portion by the feed pawl of the feed piston hits the driver that is still returning. This is because, while the fastener is energized toward the nail feed direction by the spring force, the retuning force of the striking piston caused by the negative pressure of the combustion chamber is not so strong. Thus, the front fastener scraped against the driver. As a result, the driver sometimes fails to return due to the frictional resistance caused by the slidable contact.

Therefore, JP 5-72380 U discloses a technique in which a check valve is provided in the gas tube while an discharge valve is provided in the front portion of the feed cylinder. In this configuration, the feeding operation of the feed pawl can be controlled by sending the combustion gas into the front portion of the feed cylinder to retract the feed piston, holding the retracted state, and then opening the discharge valve after the completion of the striking operation to discharge the gas inside the front portion of the feed cylinder.

However, the check valve and the discharge valve are provided near the tip end of the nose portion where it is likely to be exposed to an environment in which dust such as wood chips or fine particles of concrete is attached. Thus, it is difficult to ensure the sealing property of the valves which opens and closes in such an environment. When the valve is not surely sealed, the pressure of the feed piston can not be held. In such a case, a delaying operation of the feed piston becomes uncertain, so that the problem of scraping may arise.

DISCLOSURE OF THE INVENTION

One or more embodiments of the invention provide a gas combustion type striking tool operable to delay a feeding operation of a feed piston in a piston-cylinder mechanism for feeding fasteners relative to a returning operation of a striking piston in order to surely prevent scraping against a driver.

According to one or more embodiments of the invention, a gas combustion type striking tool includes a combustion chamber in which mixed gas obtained by mixing and stirring combustible gas and air is combusted, a striking piston which is accommodated inside a striking cylinder and is driven by the combusted gas, a driver which is coupled to a lower surface of the striking piston, a nose portion which slidably guides the driver to strike a fastener, a feed pawl which is engagable with coupled fasteners housed inside a magazine, a feed piston which is coupled with the feed pawl and reciprocates the feed pawl along a direction in which the fastener is fed toward the nose portion, a stopper which is disposed so as to be able to protrude into a moving path of the reciprocating movement of the feed pawl or the feed piston, and a stopper engaging member which is coupled to a side wall of the combustion chamber, extends downward from the striking cylinder, and is movable in a vertical direction, wherein, when the stopper engaging member moves downward, the stopper engaging member engages with the stopper to retract the stopper from the moving path along which the feed pawl or the feed piston is reciprocated.

According to one or more embodiments of the invention, the stopper engaging member includes a contact member which is movable in the vertical direction relatively along the nose portion.

According to one or more embodiments of the invention, a lower end portion of the stopper engaging member engages with the stopper.

According to one or more embodiments of the invention, the stopper protrudes by being biased by a spring.

According to one or more embodiments of the invention, because the stopper engaging member coupled the combustion chamber engages with the stopper, the fastener feeding operation delayed with respect to the returning operation of the driver is performed directly. Thus, the scraping against the driver can be surely prevented.

Further, when the stopper engaging member includes the contact member, because the contact member moves upward at the time of the striking operation, the stopper protrudes into the path of the feed pawl or the feed cylinder. Thus, the feed pawl or the feed cylinder can not move in the feed direction of the fastener. In contrast, when the nose portion moves upward of a member to be driven so as to separate therefrom after the striking operation of the fastener, because the contact member moves downward relatively, the contact member engages with the stopper to retract the stopper from the path. Thus, the feed piston and the feed pawl move in the fastener feed direction, thereby feeding the fastener into the nose portion. In this manner, since the fastener feeding operation is performed in a delayed manner with respect to the returning operation of the driver which is performed in response to the completion of the striking operation of the fastener, the scraping against the driver can be surely prevented.

Further, the protruding and retracting operations of the stopper are not performed by releasing a sealing or using another valve mechanism, but are performed in association with the stopper engagement member which is mechanically operated. Thus, the failure occurs scarcely and the reliability can be kept for a long time even in the environment where dust such as wood chips or fine particles of concrete is likely to be attached.

BRIEF DESCRIPTION OF THE DRAWINGS

FIG. 4(*b*) is a front sectional view showing the engaging relation between the feed piston-cylinder mechanism, the contact arm and the stopper.

FIG. 9(*b*) is another longitudinal sectional view showing the movement of the feed pawl.

EXPLANATION OF REFERENCE NUMERALS

Figure 1:
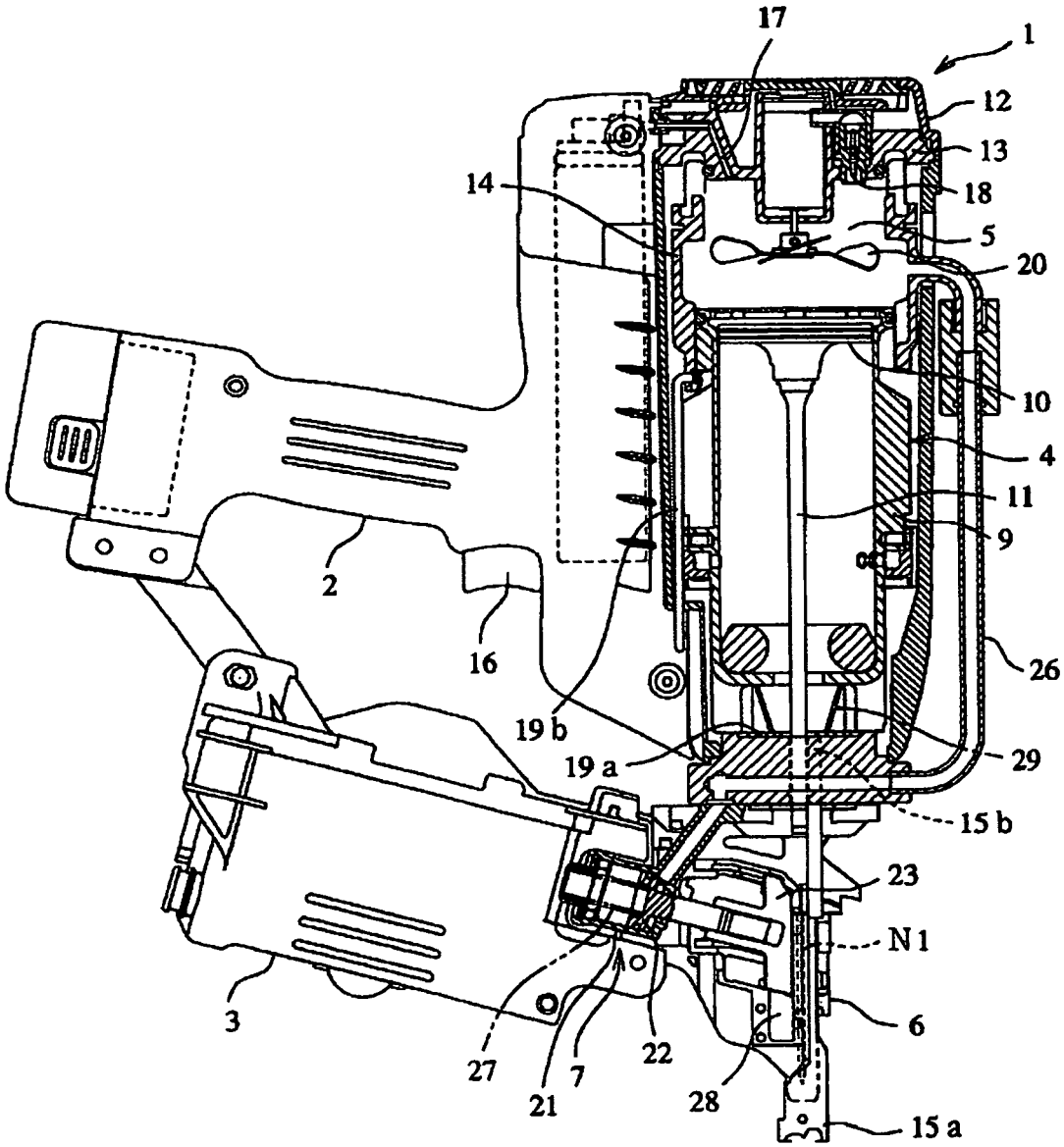
FIG. 1 is a side longitudinal sectional view showing main portions of a gas nailer according to an embodiment of the invention when it is not operated.

3 striking cylinder
5 combustion chamber
6 nose portion
11 driver
15 contact arm
28 stopper

BEST MODE FOR CARRYING OUT INVENTION

Hereinafter, a gas combustion type nailer will be explained as embodiments of the invention with reference to drawings. In FIG. 1, reference numeral 1 indicates a body of the gas nailer. The body 1 is provided with a grip 2 and a magazine 3 coupled to each other, and is further provided with a striking piston-cylinder mechanism 4, a combustion chamber 5, a nose portion 6 and a feed piston-cylinder mechanism 7 for feeding a feed piston.

In the striking piston-cylinder mechanism 4, a striking piston 10 is slidably accommodated inside a striking cylinder 9, and a driver 11 is integrally coupled to a lower portion of the striking piston 10.

The combustion chamber 5 is formed by an upper end surface of the striking piston 10, an upper wall (cylinder head) 13 formed between the striking cylinder 9 and an upper housing 12, and an annular movable sleeve 14 disposed therebetween. The combustion chamber 5 is configured such that the closed combustion chamber 5 is formed when the movable sleeve 14 is moved upward, whilst an upper portion of the combustion chamber 5 communicates with the outer air when the movable sleeve 14 is moved downward.

Figure 2:
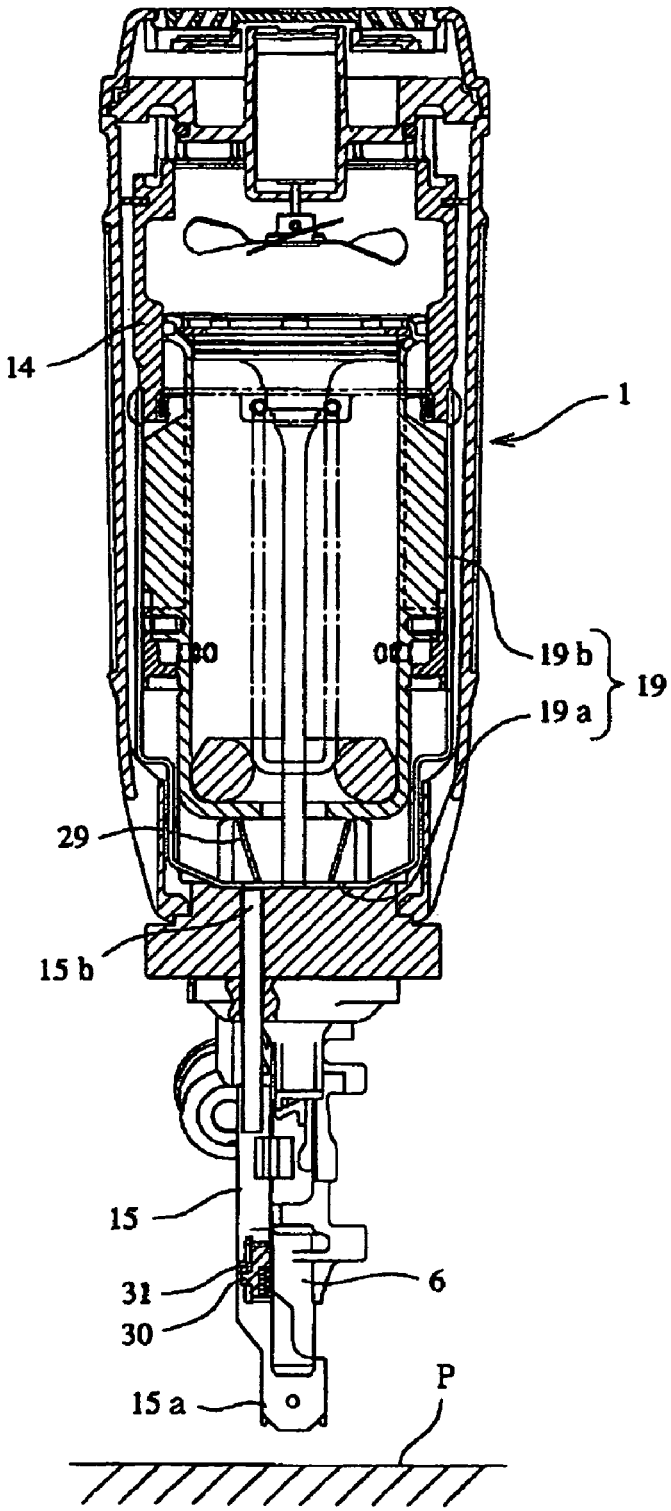
FIG. 2 is a front longitudinal sectional view showing a relation between a contact arm and a link member of the nailer.

More specifically, as shown in FIG. 2, the movable sleeve 14 is linked to a contact arm 15, serving a contact member, via a link member 19. The link member 19 includes a basket-shaped bottom portion 19*a* disposed below the striking cylinder 9 and an arm portion 19*b* extending along an outer surface of the striking cylinder 9 from an end portion of the basket-shaped bottom portion 19*a*. An upper end of the arm portion 19*b* is coupled to the movable sleeve 14, and the basket-shaped bottom portion 19*a* is biased downward by a spring 29 disposed between the basket shaped bottom portion 19*a* and a lower surface of the striking cylinder 9. The contact arm 15 is provided so as to slidable in a vertical direction along the nose portion 6. A tip end 15*a* of the contact arm 15 protrudes from the nose portion 6. When the tip end 15*a* is pressed against a material P to be nailed together with the nose portion 6, the tip end 15*a* moves upward relative to the nose portion 6 (see FIG. 3). A lower surface of the basket-shaped bottom portion 19*a* of the link member 19 engages with an upper end 15*b* of the contact arm 15. Thus, when the nose portion 6 is pressed against the material P, the contact arm 15 relatively moves upward to push up the link member 19 against a spring 29, thereby moving the movable sleeve 14 upward. Accordingly, a space inside the combustion chamber 5 is shut off from the outer air, whereby the combustion chamber 5 is closed.

In contrast, when the nailer is lifted upward due to a reaction generated immediately after the nailing, the contact arm 15 moves downward along the nose portion 6 due to its own weight. However, the pressure inside the combustion chamber 5 is negative immediately after the nailing. When the striking piston 10 moves up to its original position and the combustion chamber 5 is opened to the outer air, the movable sleeve 14 and the link member 19 relatively moves downward by the spring 29 and engages with the contact arm 15 again as shown in FIGS. 1 and 2.

An injection nozzle 17 communicating with a gas vessel, and an ignition plug 18 for igniting and firing mixed gas are disposed inside the upper housing 12. A rotary fan 20 is also provided inside the upper housing 12. The rotary fan 20 stirs the combustible gas injected inside the combustion chamber 5 and the air inside the combustion chamber 5 to create mixed gas having a predetermined air-fuel ratio inside the combustion chamber 5.

The nose portion 6 guides the sliding operation of the driver 11, and is opened to the magazine 3.

Figure 9A:
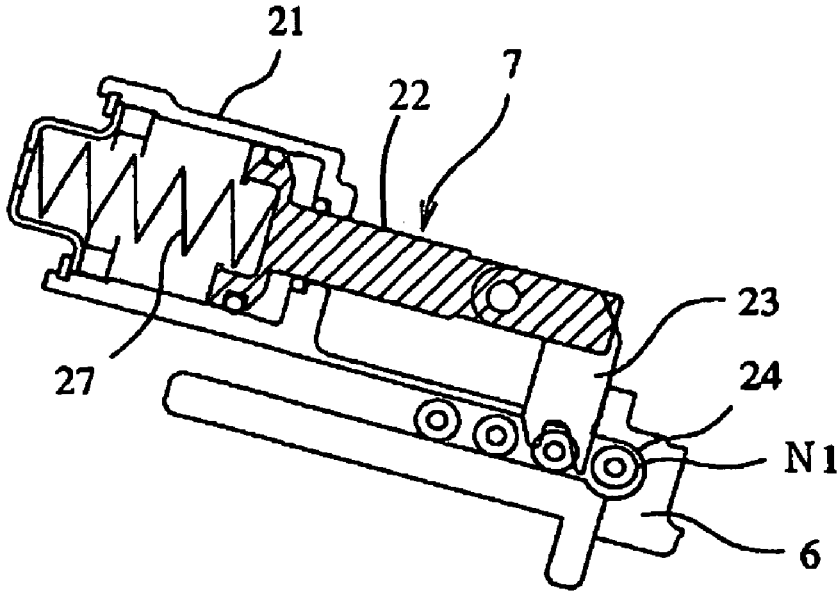
FIG. 9(*a*) is a longitudinal sectional view showing a movement of a feed pawl.
Figure 9B:
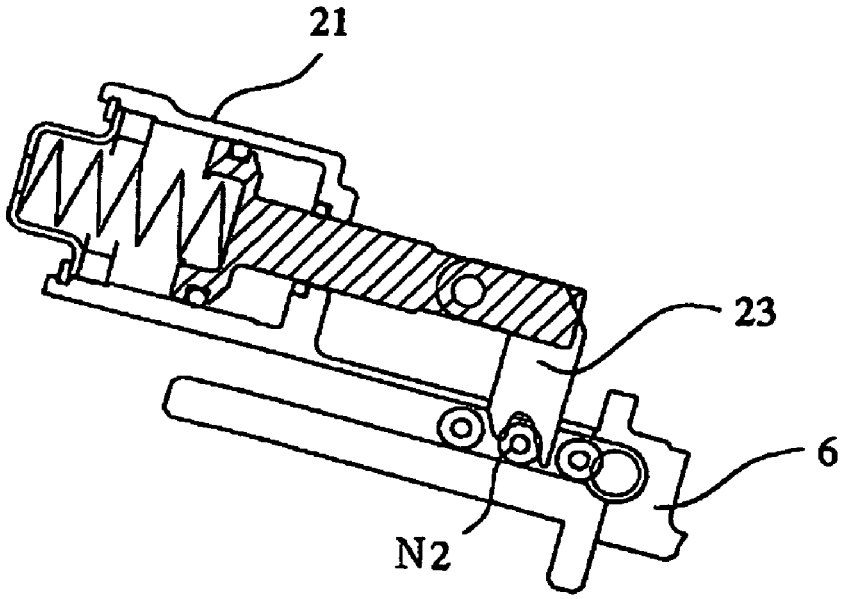

As shown in FIG. 9(*a*), in the feed piston-cylinder mechanism 7, a feed pawl 23 is coupled to the feed piston 22 (including a piston rod) which is slidably accommodated inside a feed cylinder 21, and the feed piston 22 and the feed pawl 23 are reciprocated in a nail feed direction in which the feed pawl 23 engages with coupled nails housed inside the magazine 3 to feed the coupled nails toward a side of the nose portion 6 and in a retracting direction opposite thereto as shown in FIG. 9(*b*). When the feed piston 22 is moved to the moving end of the feed direction as shown in FIG. 9(*a*), the a front nail N1 of coupled nails N is pushed into a shooting port 24 of the nose portion 6. Thus, in a state where the feed piston 22 is located at the moving end position of the feed direction, the coupled nails do not move so that the front nail N1 is held within the shooting port 24.

A front portion of the feed cylinder 21 of the feed piston-cylinder mechanism 7 is communicated with the combustion chamber 5 via a gas tube 26. A spring 27 is provided in a rear portion of the feed cylinder 21, and constantly biases the feed piston 22 toward the feed direction, i.e., in the forward direction. The feed piston 22 reciprocates in accordance with the balance between the pressure from the gas tube 26 and the force of the spring 27.

In relation to a timing at which the feed piston 22 moves in the nail feed direction by the spring 27 due to a decrease in pressure inside the feed cylinder 21 and a timing at which the striking piston 10 returns after the nailing, if the feed pawl 23 feeds a nail toward the nose portion 6 in a state where the driver 11 has not yet retracted from the nose portion 6, the nail may be scraped against the driver 11 which is moving upward inside the nose portion 6. Thus, a stopper 28 for delaying the nail feed operation of the feed piston is provided between the feed piston-cylinder mechanism 7 and the contact arm 15.

Figure 4A:
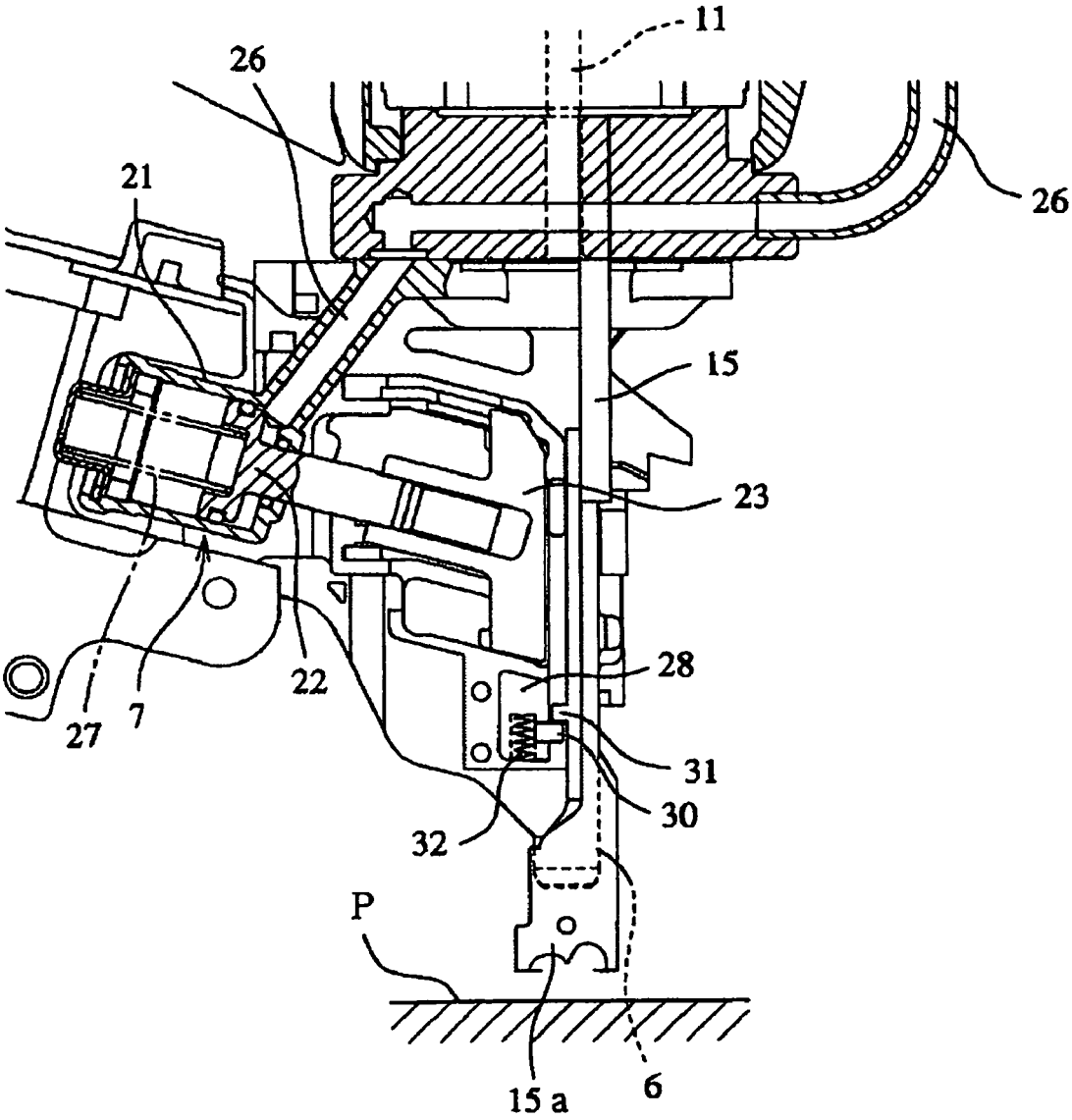
FIG. 4(*a*) is a side sectional view showing an engaging relation between a feed piston-cylinder mechanism, the contact arm and a stopper.
Figure 4B:
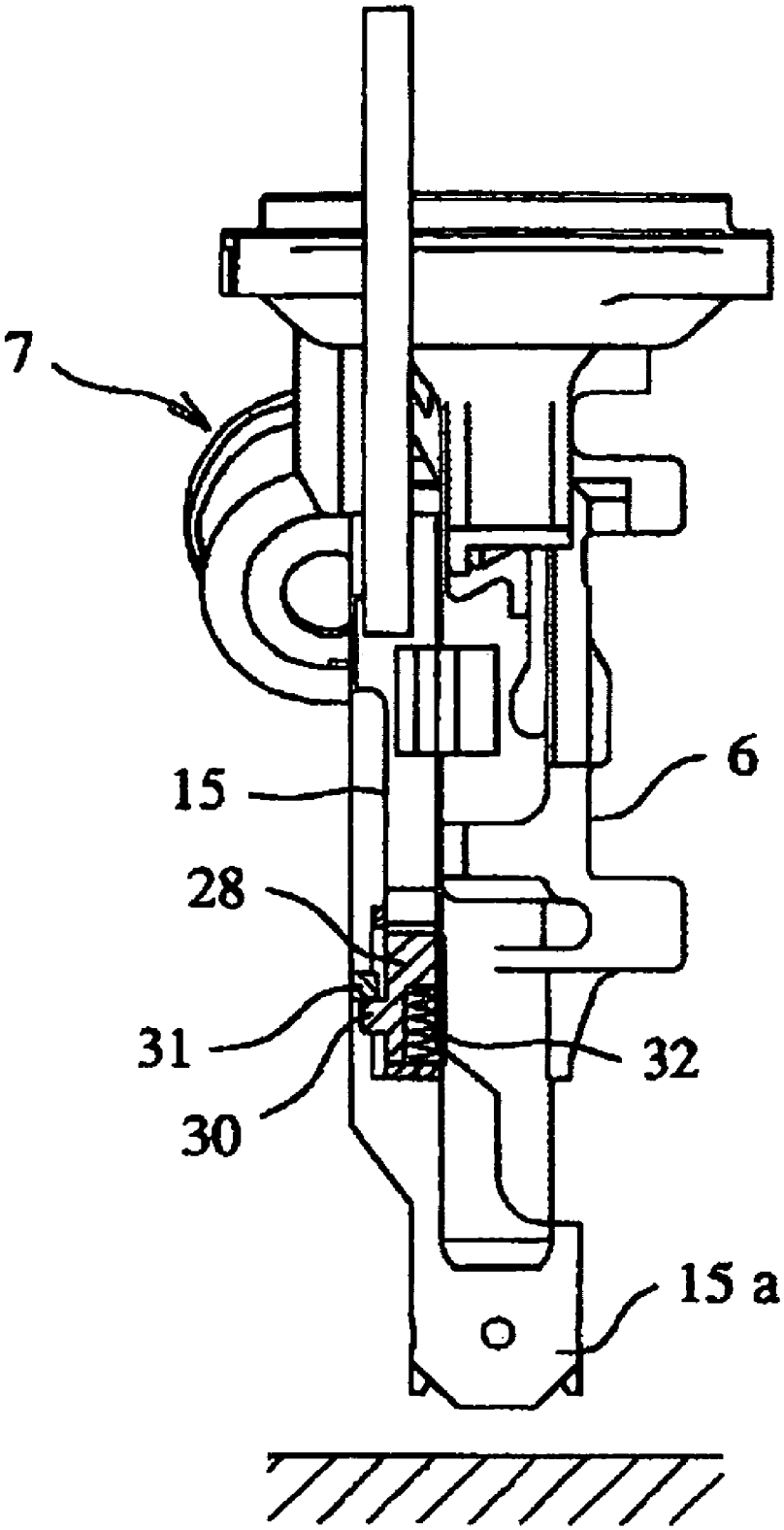

As shown in FIGS. 4(*a*) and 4(*b*), the stopper 28 is disposed so as to be movable in the vertical direction such that the stopper 28 protrudes into a moving path of the feed pawl 23. The stopper 28 is constantly biased upward by a spring 32. An engaging convex portion 30 is formed on a side surface of the stopper 28. The engaging convex portion 30 is formed at a position at which the engaging convex portion 30 is engagable with an engaging convex portion 31 formed on the contact arm 15 when the contact arm 15 moves downward.

Figure 3:
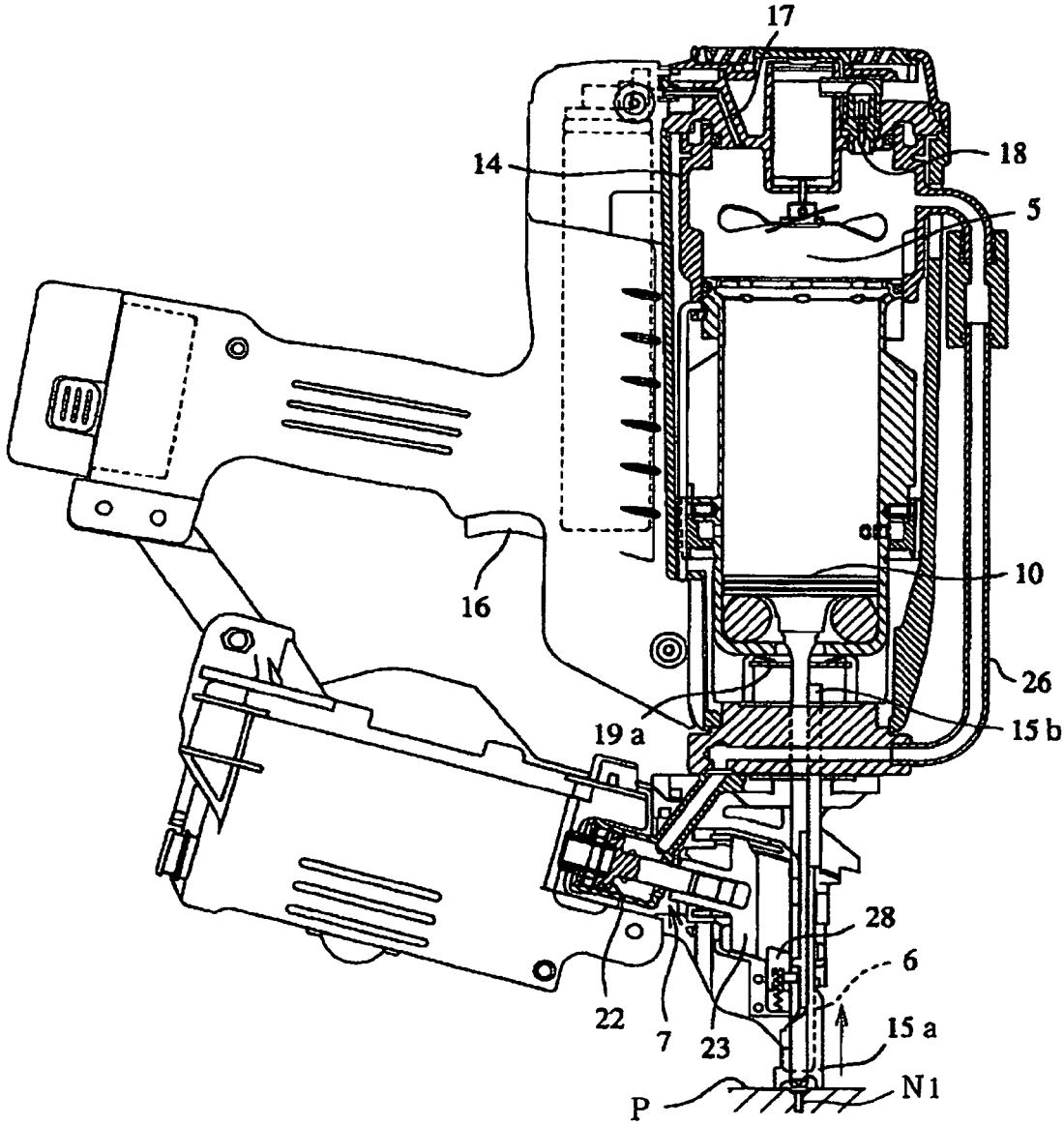
FIG. 3 is a longitudinal sectional view showing the nailer at the time of nailing.
Figure 5:
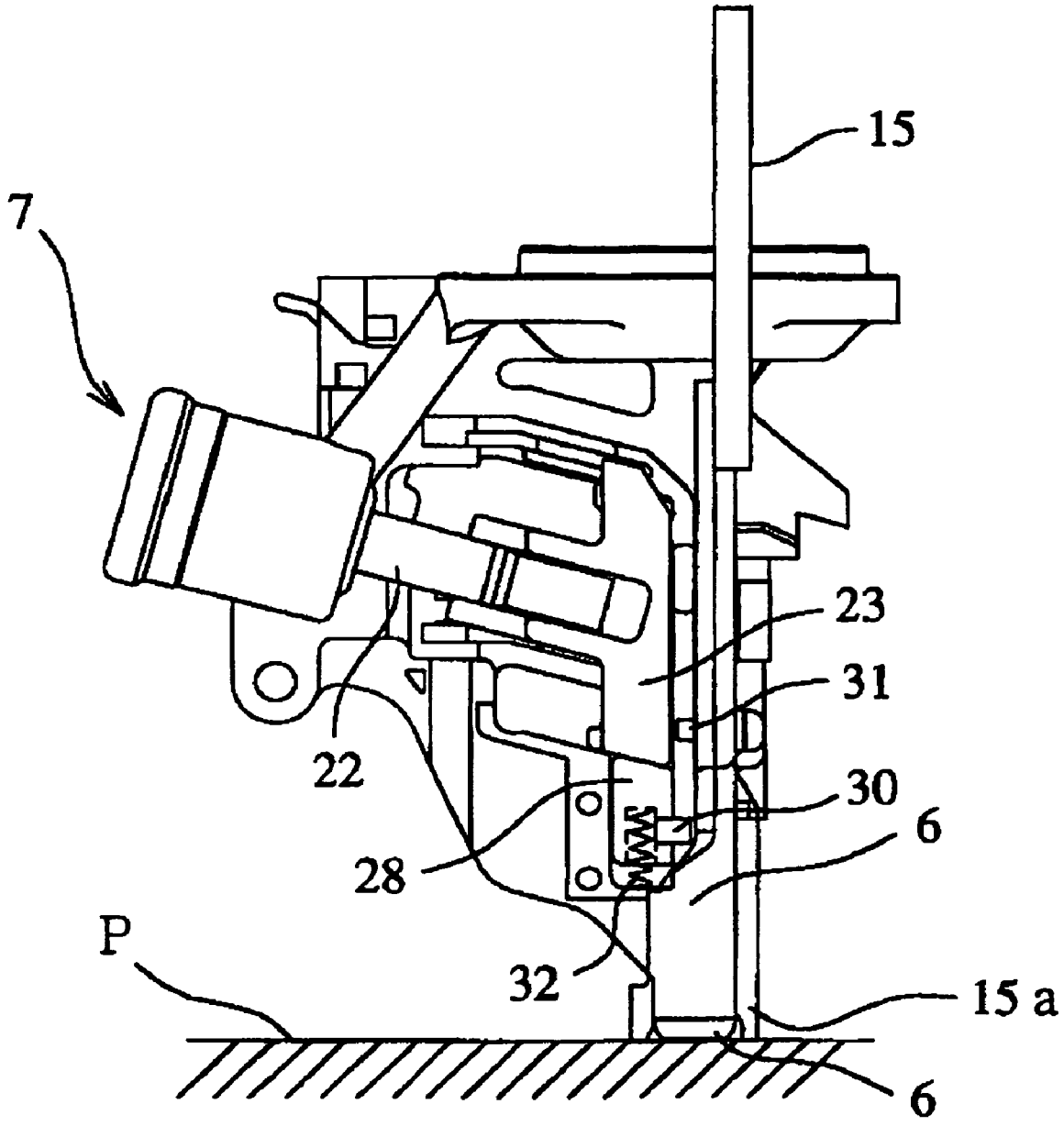
FIG. 5 is a side view of main portions in which an operation mode of a nose portion being pressed is illustrated.

Next, operations of the above mechanism will be explained. As shown in FIGS. 3 and 5, when stating a nailing operation, the tip end of the nose portion 6 is strongly pressed against the material P to be nailed so as to relatively move up the contact arm 15, whereby the movable sleeve 14 moves upward to form the closed combustion chamber 5. Further, the combustible gas is injected into the combustion chamber 5 from the injection nozzle 17, and the rotary fan 20 rotates to stir and mix the combustible gas and the air.

At this time, since the engagement with the stopper 28 is released in accordance with the upper movement of the contact arm 15, the stopper 28 moves upward by being biased by the spring 32. However, because the feed pawl 23 is already at the front end position, the stopper 28 abuts against the feed pawl 23 and stops.

Figure 6:
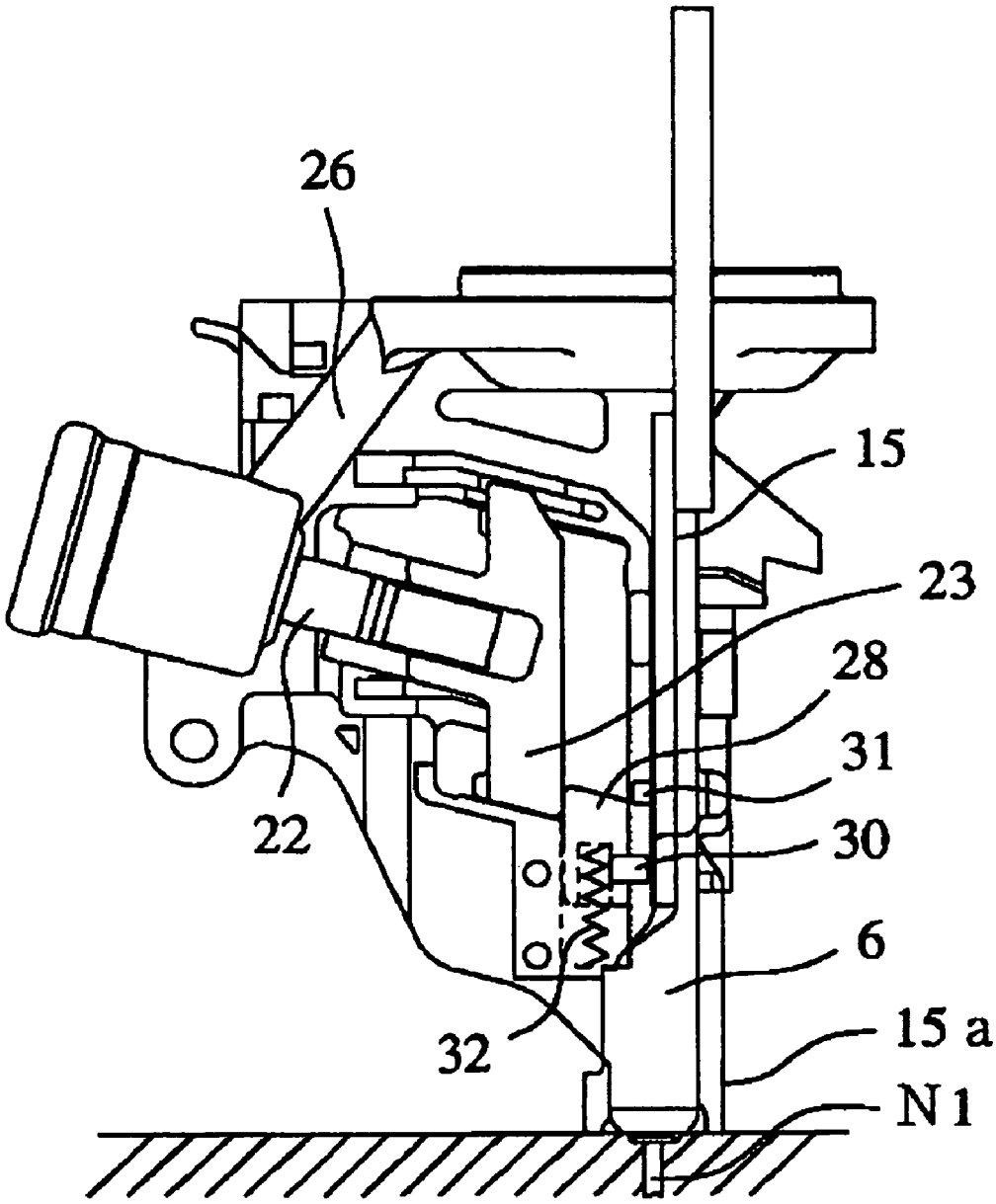
FIG. 6 is another side view of the main portions in which another operation mode of the nose portion at the time of nailing is illustrated.
Figure 7:
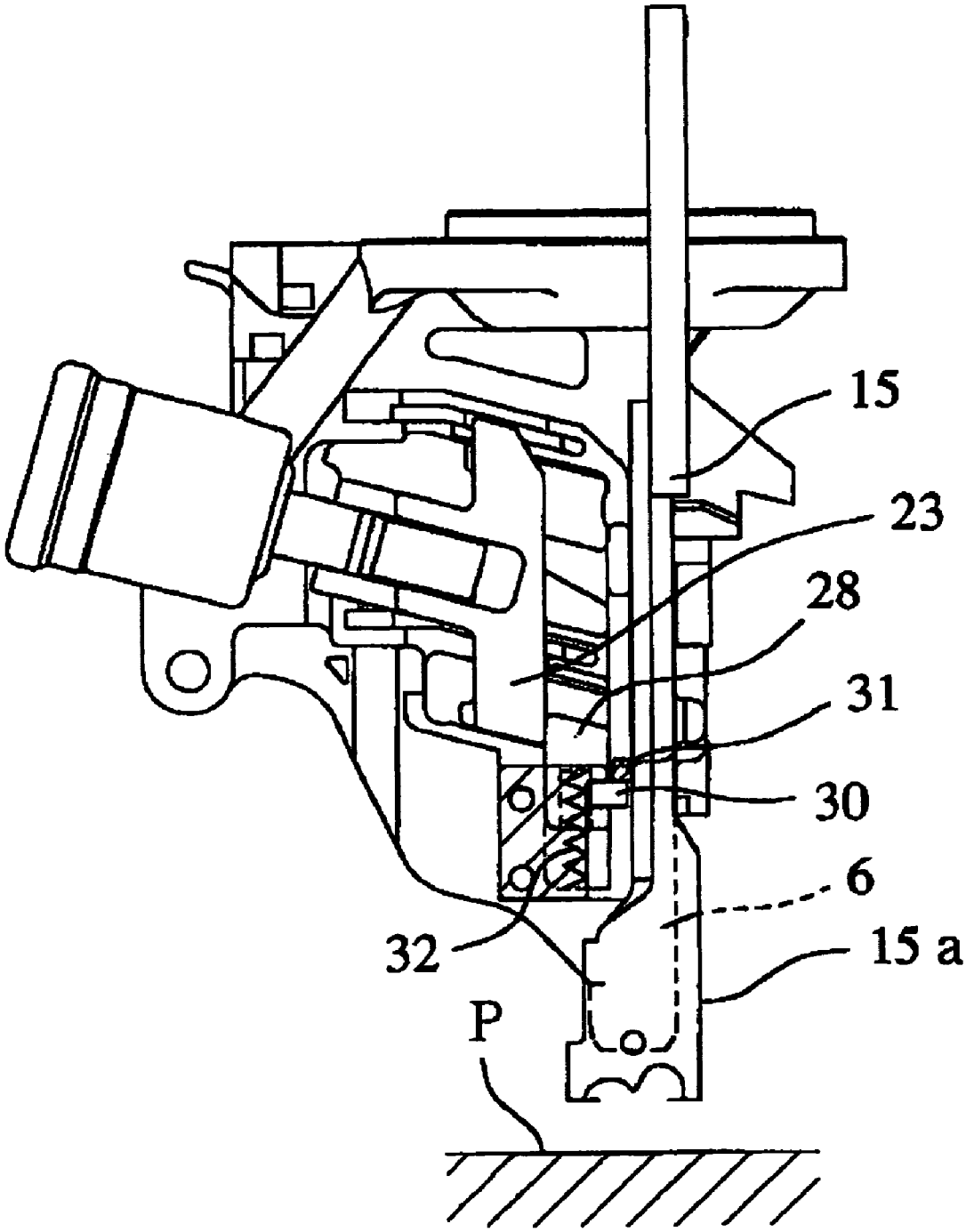
FIG. 7 is another side view of the main portions of the nailer which are lifted immediately after the nailing.
Figure 8:
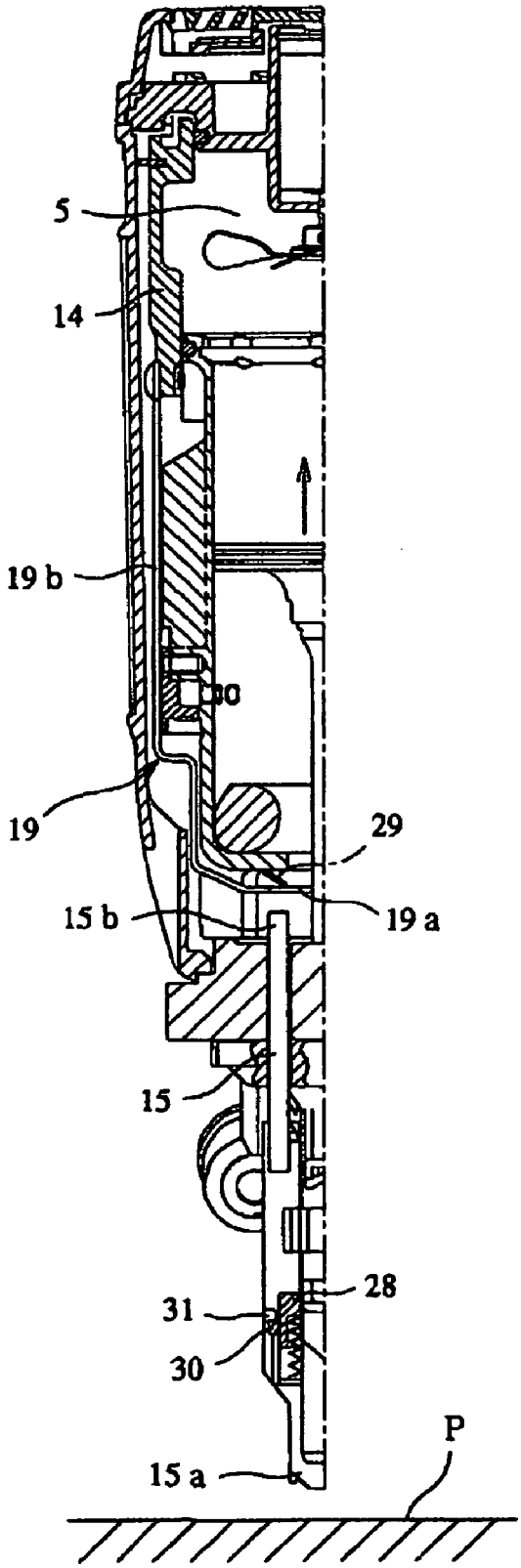
FIG. 8 is a front view showing a half of the main portions in which an operation mode of the nailer when lifted immediately after the nailing is illustrated.

Then, when a trigger 16 is pulled, the ignition plug 18 ignites the mixed gas so that the mixed gas burns and explosively expands. This pressure of the combustion gas acts on the upper surface of the striking piston 10 and drives the striking piston downward, whereby the driver 11 strikes the front nail N1 supplied inside the nose portion 6 into the material P, as shown in FIGS. 3 and 6.

Simultaneously, the pressure of the combustion gas inside the combustion chamber 5 is also supplied to the feed cylinder 21 of the feed piston-cylinder mechanism 7, whereby the feed piston 22 moves in the retracting direction against the spring 27. Because the feed pawl 23 also moves backward when the feed piston 22 is pushed back, the stopper 28 further moves upward by being biased by the spring 32, and protrudes into the moving path of the feed pawl 23 (or the feed piston 22) to prevent the forward movement of the feed pawl 23. In this state, as shown in FIG. 9(*a*), the feed piston 22 is moved to the rear portion of the feed cylinder 21 and the feed pawl 23 stands still in a state of being engaged with the second nail.

When the nailing is completed, the temperature inside the combustion chamber 5 decreases rapidly. Therefore, the volume of the combustion gas inside the combustion chamber 5 changes so as to reduce back to an original volume so that the pressure in a space above the striking piston 10, which is expanded to the striking cylinder 9, becomes negative. Thus, the striking piston 10 retunes to its upper dead position as shown in FIG. 1 due to the pressure difference with respect to the outer air below. Similarly, because the pressure inside the gas tube 26 reduces, the feed piston 22 moves in the nail feed direction by the force of the spring 27. However, as shown in FIG. 6, because the stopper 28 is located on the moving path of the feed pawl 23, the feed pawl 23 is held without further moving in the feed direction.

Thereafter, when the striking piston 10 returns to the original position shown in FIG. 1, and the combustion chamber 5 is opened to the outer air, the force of the spring 29 becomes larger than the holding force of the movable sleeve 14. Accordingly, the movable sleeve 14 and the link member 19 moves downward. Further, as shown in FIG. 4(*a*), since the force of the spring 29 also acts on the contact arm 15, the sleeve 14 and the link member 19 is further moved downward. Therefore, the stopper 28 is pushed down against the spring 32, and is retracted from the moving path of the feed pawl 23 (or the feed piston 22). Consequently, the feed piston 22 is biased by the spring 27, and is moved in the nail feed direction, whereby the front nail N1 is supplied inside the nose portion 6 so as to be ready for the next nailing operation.

Figure 10:
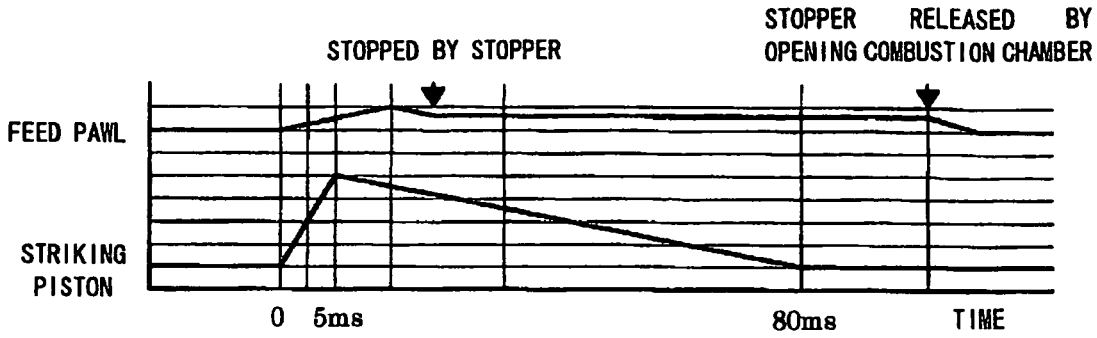
FIG. 10 is a timing chart showing a shift between timings of the feed pawl and a striking piston.

The operation timings of the feed pawl (or the feed piston 22) and the striking piston are shown in FIG. 10. At the time of the nailing operation, the feed pawl 23 is retracted almost simultaneously with the operation of the striking piston 10 by the pressure of the combustion gas. When the nailing operation is completed and the gas pressure reduces, the striking piston 10 starts to return, and the feed pawl 23 moves in the nail feed direction by the spring force and then engages with the stopper 28 on the way thereof and stops. Further, after the striking piston 10 returns to its original position, the contact arm 15 relatively moves downward to release the engagement state with the stopper 28, whereby the feed pawl 23 moves to the nail feed direction together with the feed piston 22 and feeds a nail toward the nose portion 6.

As described above, since the feed operation of the feed piston 22 is delayed with respect to the returning operation of the striking piston 10, the scraping to the driver 11 can be surely prevented, and the striking operation can be performed by maximizing the use of the pressure of the combustion gas.

Further, the protruding and retracting operations of the stopper are not performed by releasing a sealing or using another valve mechanism, but are performed in association with the contact arm which is mechanically operated. Thus, the failure occurs scarcely and the reliability can be kept for a long time even in the environment where dust such as wood chips or fine particles of concrete is likely to be attached.

Figure 11:
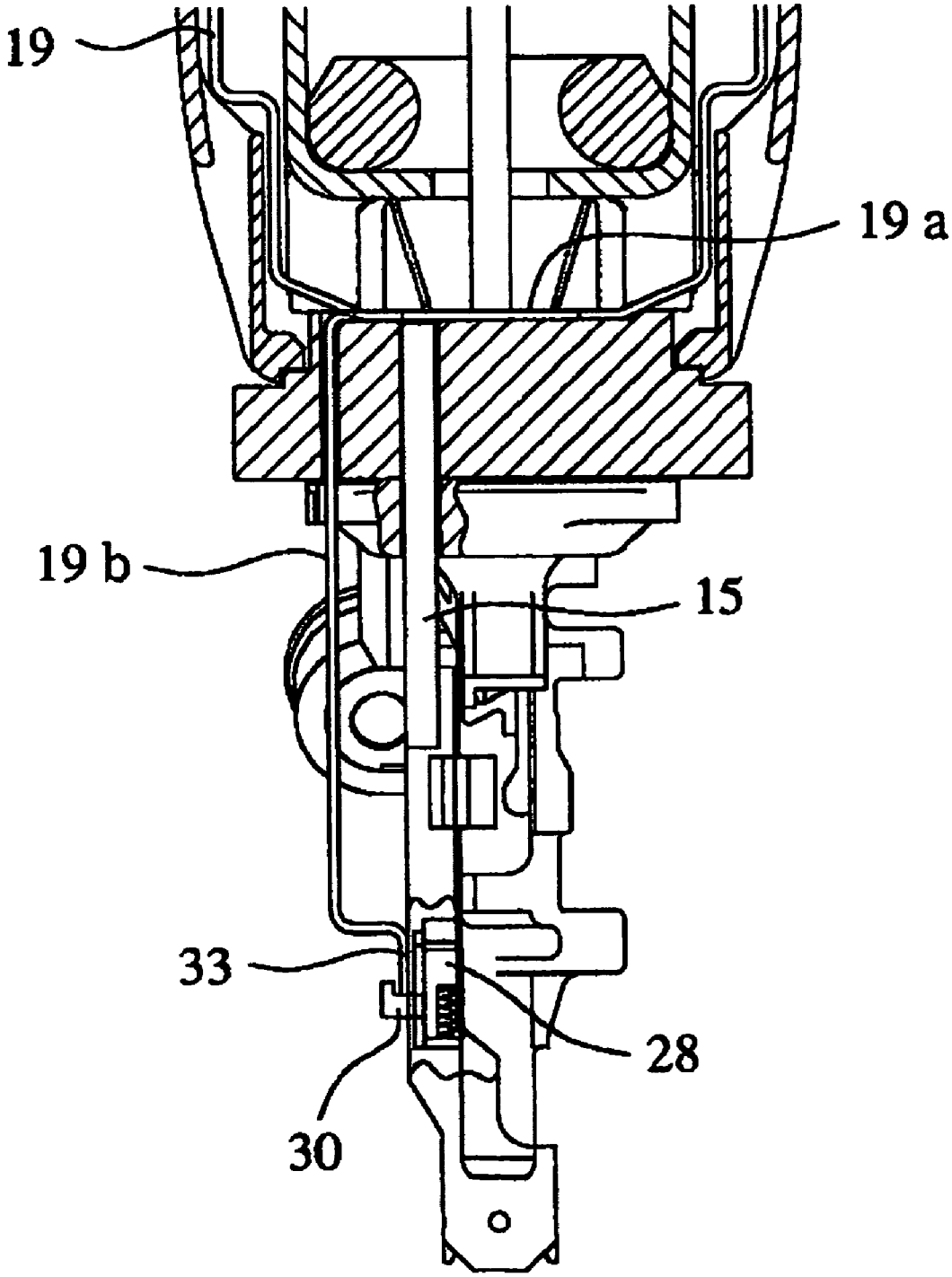
FIG. 11 is a partial front sectional view showing main portions in an example in which a stopper is operated by a link member.

The aforesaid embodiment employs the contact arm as a stopper engaging member engaging with the stopper. However, as shown in FIG. 11, a stopper engaging member may be an extended arm 19*b* downwardly extending from the basket-shaped bottom portion 19*a* of the link member 19 in parallel to the contact arm 15. Further, a lower end portion 33 of the extended arm 19*b* may be disposed so as to be able to engage with the engaging convex portion 30 of the stopper 28. According to this configuration, when the link member 19 moves downward together with the combustion chamber 5 after the nailing operation, the lower end 33 of the extended arm 19*b* engages with the engaging convex portion 30 to retract the stopper 28 from the moving path. Thus, the nail feeding operation is directly delayed with respect to the returning operation of the driver. Thus, the scraping against the driver can be surely prevented.

Further, although the explanation is made as to the case where the fastener feeding mechanism is applied to the nailer in which a nail is stroke as a fastener, the fastener feeding mechanism may be applied to a striking tool for striking a screw as a rod member having a head, or a parallel pin as a rod member having no head, etc.

Further, the stopper may be configured to operate and control the feed piston instead of the feed pawl.

Furthermore, although the contact member is explained as the contact arm which is operated separately from the nose portion in the embodiment, the contact member may be configured such that the tip end is integrally formed with the nose portion.

The magazine is not limited to the cylindrical magazine 3 but may be a straight magazine in which fasteners are fed by the feed pawl.

Although the invention has been explained as to the particular embodiment, it would be apparent for those skilled in the art that various modifications and changes may be made so long as not departing from the spirit and the scope of the invention.

The present application is based on Japanese Patent Application (Japanese Patent Application. No. 2005-144122) filed on May 17, 2005, the content of which is incorporated herein by reference.

INDUSTRIAL APPLICABILITY

The feeding operation of the feed piston is delayed with respect to the rerunning operation of the striking piston, whereby the scraping against the driver can be surely prevented.

The invention claimed is:

1. A gas combustion type striking tool comprising:

a combustion chamber in which mixed gas obtained by mixing and stirring combustible gas and air is combusted;

a striking piston which is accommodated inside a striking cylinder and is driven by the combusted gas;

a driver which is coupled to a lower surface of the striking piston;

a nose portion which slidably guides the driver to strike a fastener;

a feed pawl which is engagable with coupled fasteners housed inside a magazine;

a feed piston which is coupled with the feed pawl and reciprocates the feed pawl along a direction in which the fastener is fed toward the nose portion;

a stopper which is disposed so as to protrude into and out of a moving path of the reciprocating movement of the feed pawl; and a stopper engaging member which is coupled to a side wall of the combustion chamber, extends downward from the striking cylinder, and moves in a vertical direction, wherein, when the stopper engaging member moves downward, the stopper engaging member engages with the stopper to retract the stopper from the moving path along which the feed pawl is reciprocated.

2. The gas combustion type striking tool according to claim 1, wherein the stopper engaging member includes a contact member which moves in the vertical direction relatively along the nose portion.

3. The gas combustion type striking tool according to claim 1, wherein a lower end portion of the stopper engaging member engages with the stopper.

4. The gas combustion type striking tool according to claim 1, wherein the stopper protrudes by being biased by a spring.

5. A gas combustion type striking tool comprising:

a combustion chamber in which mixed gas obtained by mixing and stirring combustible gas and air is combusted;

a striking piston which is accommodated inside a striking cylinder and is driven by the combusted gas;

a driver which is coupled to a lower source of the striking piston;

a nose portion which slidably guides the driver to strike a fastener;

a feed pawl which engages coupled fasteners housed inside a magazine;

a feed piston which is coupled with the feed pawl and reciprocates the feed pawl along a direction in which the fastener is fed toward the nose portion;

a stopper which is disposed so as to protrude into and out of a moving path of a reciprocating movement of the feed piston; and a stopper engaging member which is coupled to a side wall of the combustion chamber, extends downward from the striking cylinder, and moves in a vertical direction, wherein, when the stopper engaging member moves downward, the stopper engaging member engages with the stopper to retract the stopper from the moving path along which the feed piston is reciprocated.

6. The gas combustion type striking tool according to claim 5, wherein the stopper engaging member includes a contact member which moves in the vertical direction relatively along the nose portion.

7. The gas combustion type striking tool according to claim 5, wherein a lower end portion of the stopper engaging member engages with the stopper.

8. The gas combustion type striking tool according to claim 5, wherein the stopper protrudes by being biased by a spring.

* * * * *